US009485830B2

(12) United States Patent
Sakai et al.

(10) Patent No.: US 9,485,830 B2
(45) Date of Patent: Nov. 1, 2016

(54) LED LIGHTING APPARATUS

(75) Inventors: Keisuke Sakai, Chiba (JP); Rintaro Takahashi, Saitama (JP); Takashi Akiyama, Saitama (JP)

(73) Assignees: CITIZEN HOLDINGS CO., LTD., Tokyo (JP); CITIZEN ELECTRONICS CO., LTD., Yamanashi (JP)

( * ) Notice: Subject to any disclaimer, the term of this patent is extended or adjusted under 35 U.S.C. 154(b) by 0 days.

(21) Appl. No.: 14/232,778

(22) PCT Filed: Jul. 12, 2012

(86) PCT No.: PCT/JP2012/067857
§ 371 (c)(1),
(2), (4) Date: Jan. 14, 2014

(87) PCT Pub. No.: WO2013/011924
PCT Pub. Date: Jan. 24, 2013

(65) Prior Publication Data

US 2014/0197741 A1 Jul. 17, 2014

(30) Foreign Application Priority Data

Jul. 15, 2011 (JP) ..... 2011-156303

(51) Int. Cl.
*H05B 33/08* (2006.01)

(52) U.S. Cl.
CPC ..... *H05B 33/089* (2013.01); *H05B 33/083* (2013.01); *H05B 33/0824* (2013.01)

(58) Field of Classification Search
USPC ..... 315/123
See application file for complete search history.

(56) References Cited

U.S. PATENT DOCUMENTS 8,283,870 B2 * 10/2012 Ger et al. ..... 315/125
8,471,495 B2 * 6/2013 Muguruma ..... H05B 33/083 315/185 R (Continued)

FOREIGN PATENT DOCUMENTS

EP 2187706 A2 5/2010
EP 2542033 A1 1/2013

(Continued)

OTHER PUBLICATIONS

International Search Report for PCT/JP2012/067857, Oct. 9, 2012.

(Continued)

*Primary Examiner* — Alexander H Taningco
*Assistant Examiner* — Nelson Correa

(57) ABSTRACT

When an LED lighting apparatus which is a lighter load than an incandescent lamp or halogen lamp is connected to a dimmer, a malfunction may occur. The invention prevents the occurrence of such malfunction without defeating the purpose of low power consumption of the LED lighting apparatus. More specifically, the LED lighting apparatus includes a rectifier circuit, a light-emitting circuit connected to the rectifier circuit and containing a single or a plurality of LEDs in which current begins to flow when an output voltage of the rectifier circuit exceeds a threshold voltage, and a bypass circuit having a bypass path for making the current flow to the rectifier circuit without passing through the light-emitting circuit, and a detecting unit for detecting the current flowing through the light-emitting circuit, and wherein when the current detected by the detecting unit exceeds a predetermined value, the bypass circuit shuts off the current flowing through the bypass path.

7 Claims, 10 Drawing Sheets

(56) References Cited

U.S. PATENT DOCUMENTS

| | | | | |
|---|---|---|---|---|
| 8,492,992 | B2 * | 7/2013 | Otake | H05B 33/0824 315/291 |
| 8,519,631 | B2 * | 8/2013 | Lee et al. | 315/193 |
| 8,638,043 | B2 * | 1/2014 | Chiang et al. | 315/291 |
| 8,742,671 | B2 * | 6/2014 | van de Ven | H05B 33/0824 315/125 |
| 8,933,636 | B2 * | 1/2015 | Egawa et al. | 315/192 |
| 2008/0278092 | A1 * | 11/2008 | Lys et al. | 315/247 |
| 2010/0109535 | A1 | 5/2010 | Lin | |
| 2011/0068706 | A1 | 3/2011 | Otake et al. | |
| 2011/0199003 | A1 | 8/2011 | Muguruma et al. | |
| 2012/0038285 | A1 | 2/2012 | Leung et al. | |
| 2012/0313541 | A1 | 12/2012 | Egawa et al. | |
| 2013/0234609 | A1 * | 9/2013 | Akiyama | 315/185 R |

FOREIGN PATENT DOCUMENTS

| | | | |
|---|---|---|---|
| EP | 2604093 | A | 6/2013 |
| JP | 2011-3467 | A | 1/2011 |
| JP | 2011-040701 | A | 2/2011 |
| JP | 2011-65922 | A | 3/2011 |
| JP | 3167927 | U | 5/2011 |
| WO | 2011/020007 | A1 | 2/2011 |
| WO | 2012/019389 | A1 | 2/2012 |

OTHER PUBLICATIONS

European Patent Office, Extended European Search Report for EP Patent Application No. 12815542.1 , Aug. 27, 2015.

European Patent Office, Office Action for EP Patent Application No. 12815542.1 , Jun. 30, 2016.

* cited by examiner

Fig.3( a )
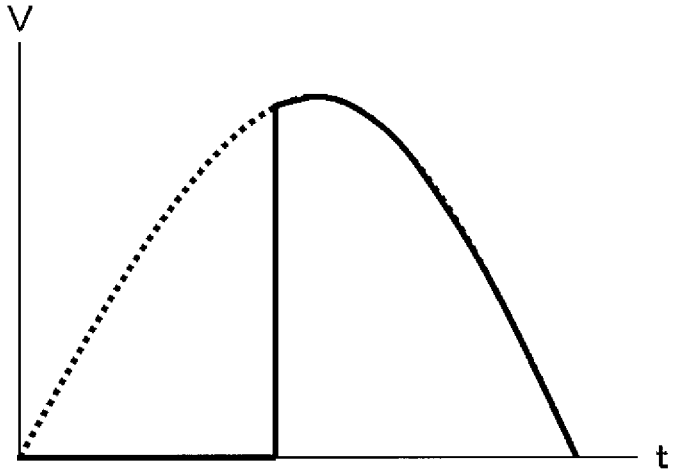
Fig.3( b )
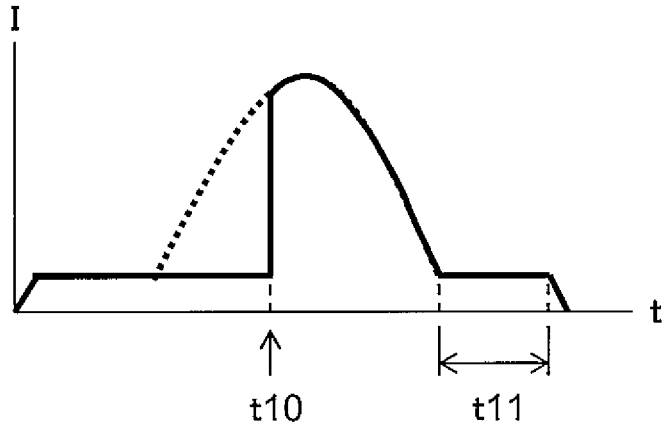

Fig.5( a )
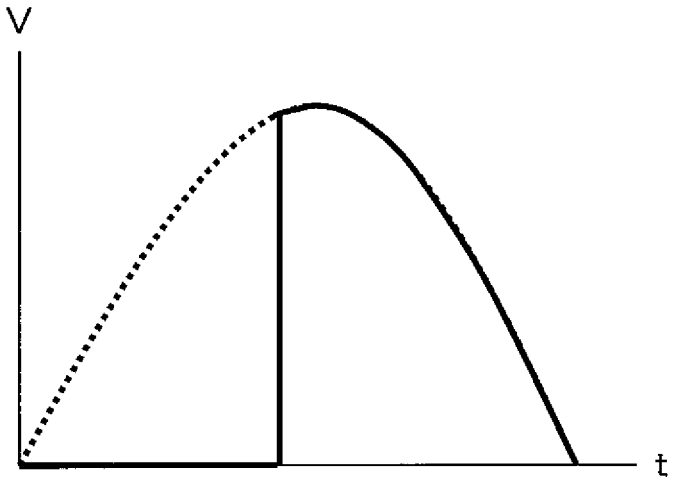
Fig.5( b )
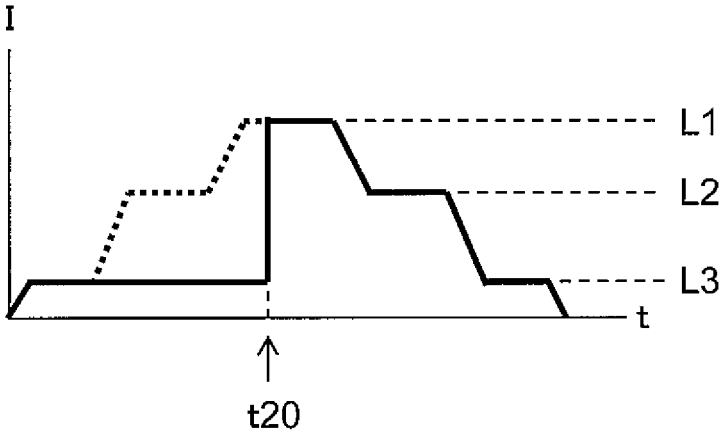

Fig.8( a )
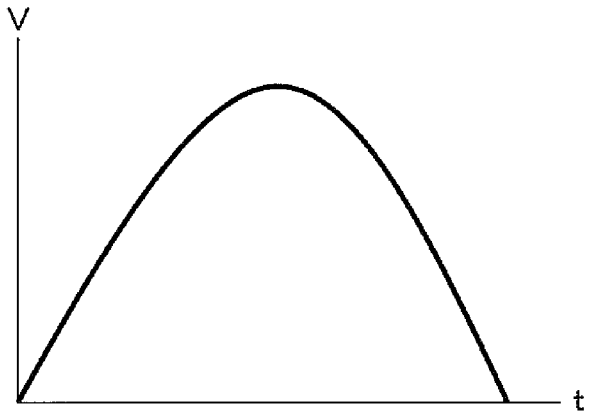
PRIOR ART
Fig.8( b )
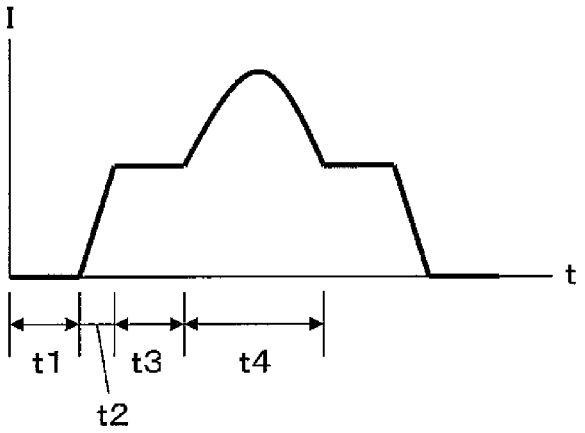
PRIOR ART

Fig.10( a )
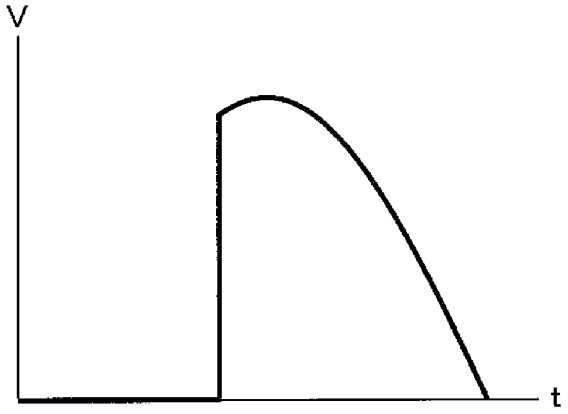
PRIOR ART
Fig.10( b )
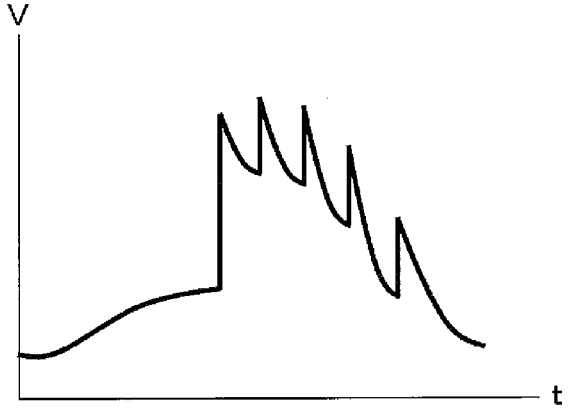
PRIOR ART

LED LIGHTING APPARATUS

TECHNICAL FIELD

The present invention relates to an LED lighting apparatus for lighting an LED by using an output of a dimmer.

BACKGROUND

A lighting apparatus (hereinafter called an LED lighting apparatus) is known which is connected to an AC commercial power supply and used for lighting an LED (also called a light-emitting diode). Such LED lighting apparatus commonly operates by rectifying the power supplied from the AC commercial power supply. In particular, a pulsating or near-pulsating voltage may be applied across an LED array constructed by connecting a large number of LEDs in series without requiring the use of large capacitors.

If a pulsating voltage is directed applied to the LED array, the light emission period becomes short; to address this, it is known to provide a circuit for adjusting the number of series-connected LED stages by detecting the current flowing through the LED array (for example, refer to patent document 1).

FIG. 7 is a diagram showing an LED lighting apparatus illustrated in FIG. 26 in patent document 1. For convenience, FIG. 7 includes numbers, currents, etc. where necessary.

The LED lighting apparatus shown in FIG. 7 includes an AC commercial power supply 712, a bridge rectifier circuit 705 constructed from four diodes, a first LED group and a second LED group arranged in parallel, a third LED group connected in series to the first and second LED groups, resistors R1, R2, and R3, an n-type MOS transistor (FET) Q1, and an NPN transistor Q2.

The resistors R2 and R3 and the transistors Q1 and Q2 together constitute a bypass circuit 717. A current output terminal A of the bridge rectifier circuit 705 is connected to the parallel-connected first and second LED groups. The cathode side of the parallel-connected first and second LED groups is connected to the bypass circuit 717 as well as to the anode side of the third LED group. A current I3 passing through the bypass circuit 717 and a current I4 passing through the third LED group flow into the current sensing resistor R3 and the base of the transistor Q2 contained in the bypass circuit 717.

FIG. 8 is a diagram showing a voltage versus current relationship for the LED lighting apparatus of FIG. 7. FIG. 8(*a*) shows an example of a voltage waveform for one pulsating cycle that appears at the terminal A with respect to the terminal B of the bridge rectifier circuit 705, and FIG. 8(*b*) is an example of a current waveform for one pulsating cycle that flows in the bridge rectifier circuit 705. The current waveform shown in FIG. 8(*b*) is approximately equal to the sum of the currents I3 and I4.

The currents I3 and I4 are both equal to 0 A during a period t1 when the voltage at the terminal A is lower than the threshold voltage of the parallel-connected first and second LED groups. When the voltage at the terminal A subsequently rises and exceeds the threshold voltage of the parallel-connected first and second LED groups, the current increases rapidly for a short period t2. When the voltage at the terminal A further rises, there appears a period t3 during which the sum of the currents I3 and I4 is constant. In the first half of the period t3, only the current I3 flows through the bypass circuit 717, and in the second half of the period t3, the current I4 flows not only through the bypass circuit 717 but also through the third LED group. At this time, the currents I3 and I4 are regulated so that the base-emitter voltage of the transistor Q2 is maintained at 0.6 V.

Next, when the voltage at the terminal A rises, entering a period t4 which contains the peak of the voltage waveform, the transistor Q2 is saturated, and the bypass circuit 717 is cut off, so that the current I3 no longer flows. In the period t4, the overall current varies substantially linearly with the voltage of the terminal A, since the current I4 is only limited by the current-limiting resistor R3. The period during which the voltage of the terminal A falls is the reverse of the period during which the voltage rises.

The LED lighting apparatus of FIG. 7 has the advantage that, since the period t1 during which all the LEDs are turned off is short, not only does flicker decrease, but power factor and distortion factor both improve and harmonic noise also decreases.

In the prior art, it is also known to provide an LED lighting apparatus that includes a dimmer circuit between the AC commercial power supply and the bridge rectifier circuit (for example, refer to patent document 2). In the LED lighting apparatus disclosed in patent document 2, a pulsating voltage output from the bridge rectifier circuit is smoothed using a large-capacitance capacitor, and the thus smoothed voltage is used for lighting an LED.

PRIOR ART DOCUMENTS

Patent Documents

Patent document 1: WO2011/020007 (FIG. 26)
Patent document 2: Japanese Unexamined Patent Publication No. 2011-3467 (FIG. 1)

SUMMARY

FIG. 9 is a diagram showing an example in which a dimmer 901 is inserted between the AC commercial power supply and the bridge rectifier circuit 705 in the LED lighting apparatus shown in FIG. 7.

The dimmer 901 shown in FIG. 9 is a leading-edge type dimmer, which varies the intensity of LED light by controlling the phase of the voltage waveform being output from the AC commercial power supply 712. For example, the dimmer 901 operates as if the voltage is present only in the second half portion by truncating the first half portion of the pulsating voltage shown in FIG. 8(*a*), and varies the intensity of LED light by adjusting the length of the period during which the voltage is present.

FIG. 10 is a diagram showing a voltage versus current relationship for the LED lighting apparatus of FIG. 9. FIG. 10(*a*) shows an example of a voltage waveform for one pulsating cycle that appears at the terminal A with respect to the terminal B of the bridge rectifier circuit 705 for an ideal load, and FIG. 10(*b*) is an example of a voltage waveform for one pulsating cycle that the bridge rectifier circuit 705 outputs in the circuit shown in FIG. 9.

In the voltage waveform of FIG. 10(*a*), the first half portion of the pulsating voltage shown in FIG. 8(*a*) is truncated by the action of the dimmer 901. As shown in FIG. 10(*b*), a gradually increasing voltage appears at the output of the bridge rectifier circuit 705 during the first half period when no voltage should be present. In the second half period, a plurality of sharp peaks appear on the voltage being output at the terminal A of the bridge rectifier circuit 705, as shown in FIG. 10(*b*). Here, if the current flowing through the parallel-connected first and second LED groups is increased up to a certain point, the peaks appearing as shown in FIG.

10(*b*) can be made to disappear, but the abnormal voltage in the first half period does not disappear.

The reason that a faulty operation such as shown in FIG. 10(*b*) occurs is believed to be that there is a need to flow a certain amount of current in order to properly operate the dimmer 901. In actuality, however, in the period during which the voltage waveform of FIG. 10(*a*) is substantially held to zero, the current minimum necessary for proper operation does not flow to the dimmer 901.

A faulty operation such as shown in FIG. 10(*b*) can occur not only when the LED lighting apparatus shown in FIG. 7 is connected to the dimmer 901, but also when the LED lighting apparatus which is a lighter load than an incandescent lamp or halogen lamp is connected to any dimmer other than the above dimmer. If the load is increased by forming a current path in parallel with the light load LED apparatus, the above faulty operation may be able to be resolved. However, increasing the load in such a manner would defeat the purpose of low power consumption of the LED lighting apparatus.

By contrast, the LED lighting apparatus disclosed in patent document 2 is provided with a load circuit 7 for holding a minimum current necessary for the proper operation of the dimmer circuit 2. However, the LED lighting apparatus disclosed in patent document 2 is further provided with a smoothing circuit 4 which includes a capacitor, and the voltage output from the rectifier circuit 3 is first smoothed and then supplied to a lighting circuit 5 for lighting the load 6 such as an LED.

As a result, in the LED lighting apparatus disclosed in patent document 2, the load 6 such as an LED is DC driven. To adjust the intensity of LED light in DC driving, the lighting circuit 5 detects the phase with which the dimmer circuit 2 supplies power and, in accordance with the thus detected phase, controls the DC voltage to be supplied to the load 6 such as an LED. Such lighting control requires not only complicated control circuitry but also a stable DC voltage supply. This therefore requires the provision of a large-capacitance capacitor in the smoothing circuit 4, and such a large-capacitance capacitor becomes an obstacle to reducing the circuit size. Furthermore, if an electrolytic capacitor, for example, is used as the large-capacitance capacitor, there arise problems such as reduced lifetime due to the effects of the heat generated by the LED, reducing the lifetime of the LED lighting apparatus itself or requiring frequent maintenance.

Accordingly, it is an object of the present invention to provide an LED lighting apparatus that uses an LED as a light source, and that can operate properly even when operated using an output of a dimmer and can yet reduce power consumption.

It is another object of the present invention to provide an LED lighting apparatus that can be implemented with simple circuitry without using a smoothing circuit and that does not cause malfunction of a dimmer.

An LED lighting apparatus includes a rectifier circuit, a light-emitting circuit connected to the rectifier circuit and containing a single or a plurality of LEDs in which current begins to flow when an output voltage of the rectifier circuit exceeds a threshold voltage, and a bypass circuit having a bypass path for making the current flow to the rectifier circuit without passing through the light-emitting circuit, and a detecting unit for detecting the current flowing through the light-emitting circuit, and wherein when the current detected by the detecting unit exceeds a predetermined value, the bypass circuit shuts off the current flowing through the bypass path.

Preferably, in the LED lighting apparatus, the bypass circuit maintains the sum of the current flowing through the bypass circuit and the current flowing through the light-emitting circuit constant.

Preferably, in the LED lighting apparatus, the bypass circuit includes a current detecting resistor and a depletion-type FET placed in the bypass path, wherein the depletion-type FET controls opening and closing of the bypass path by detecting the current flowing through the light-emitting circuit by the current detecting resistor.

Preferably, in the LED lighting apparatus, the bypass circuit includes a current detecting resistor and an enhancement-type FET placed in the bypass path, a bipolar transistor for controlling the enhancement-type FET, and a pull-up resistor, wherein the bipolar transistor detects the current flowing through the light-emitting circuit by the current detecting resistor, and controls opening and closing of the bypass path by using the enhancement-type FET.

Preferably, the LED lighting apparatus further includes a second bypass circuit connected to the light-emitting circuit, a second light-emitting circuit connected to the second bypass circuit and containing a single or a plurality of LEDs in which current begins to flow when the output voltage of the rectifier circuit exceeds a threshold voltage, and a current limiting circuit for limiting the current flowing into the second light-emitting circuit.

Preferably, the LED lighting apparatus further comprises a filter circuit connected in parallel with the bypass circuit and constructed from a series connection of a resistor and a capacitor.

Preferably, in the LED lighting apparatus, the filter circuit is placed after the bypass circuit but before the light-emitting circuit.

An LED lighting apparatus includes a rectifier circuit, a light-emitting circuit containing a single or a plurality of LEDs, the light-emitting circuit having a first power supply terminal and a second power supply terminal, and a bypass circuit having a third power supply terminal, a fourth power supply terminal, and a current detecting terminal, wherein the first power supply terminal and the third power supply terminal are connected to one end of the rectifier circuit, the second power supply terminal is connected to the current detecting terminal, and the fourth power supply terminal is connected to the other end of the rectifier circuit, and wherein when the voltage developed between the one end and the other end of the rectifier circuit is low, current flows through the third power supply terminal, and when the current flowing through the current detecting terminal exceeds a predetermined value, the current flowing through the third power supply terminal no longer flows, while when the voltage at the one end of the rectifier circuit exceeds the threshold voltage of the single LED or the threshold voltage of an LED array of the plurality of LEDs connected in series, the current flows through the single LED or the LED array into the current detecting terminal.

A dimmer receives a voltage from an AC commercial power supply, and modifies the voltage waveform in such a manner that the voltage is present only in a specific period and no voltage is present in the remaining period. However, even in the no-voltage period, the voltage is not completely zero but a slight amount of voltage is present. Therefore, in the LED lighting apparatus, current is allowed to flow through the bypass circuit in the no-voltage period in order to stabilize the operation of the dimmer. In the no-voltage period, no current flows to the light-emitting circuit because there is a threshold voltage for the operation of the LEDs. Even when current begins to flow into the light-emitting circuit immediately after the output of the dimmer transitions to the voltage period, the stable operation of the dimmer is maintained. When the output of the dimmer transitions to the voltage period, and the current flowing through the light-emitting circuit exceeds a predetermined value, the bypass circuit is cut off, and the current thus flows only through the light-emitting circuit. Therefore, the LED lighting apparatus of the invention can operate properly even when operated using the output of the dimmer and can yet reduce power consumption.

BRIEF DESCRIPTION OF THE DRAWINGS

FIG. 3(*a*) is a diagram depicting the voltage measured at terminal A with respect to terminal B in the LED lighting apparatus 100 shown in FIG. 1.

FIG. 3(*b*) is a diagram depicting the waveform of current I flowing through terminal A in response to the voltage of FIG. 3(*a*).

FIG. 5(*a*) is a diagram depicting the voltage measured at terminal A with respect to terminal B in the LED lighting apparatus 400 shown in FIG. 4.

FIG. 5(*b*) is a diagram depicting the waveform of current I flowing through terminal A in response to the voltage of FIG. 5(*a*).

FIG. 8(*a*) is a diagram showing an example of a voltage waveform for one pulsating cycle that appears at terminal A with respect to terminal B of a bridge rectifier circuit 705 in the LED lighting apparatus shown in FIG. 7.

FIG. 8(*b*) is an example of a current waveform for one pulsating cycle that flows in the bridge rectifier circuit 705 in the LED lighting apparatus shown in FIG. 7.

FIG. 10(*a*) is a diagram showing an example of a voltage waveform for one pulsating cycle that appears at terminal A with respect to terminal B of the bridge rectifier circuit 705 for an ideal load.

FIG. 10(*b*) is an example of a voltage waveform for one pulsating cycle that the bridge rectifier circuit 705 outputs in the LED lighting apparatus shown in FIG. 9.

DESCRIPTION

Figure 1:
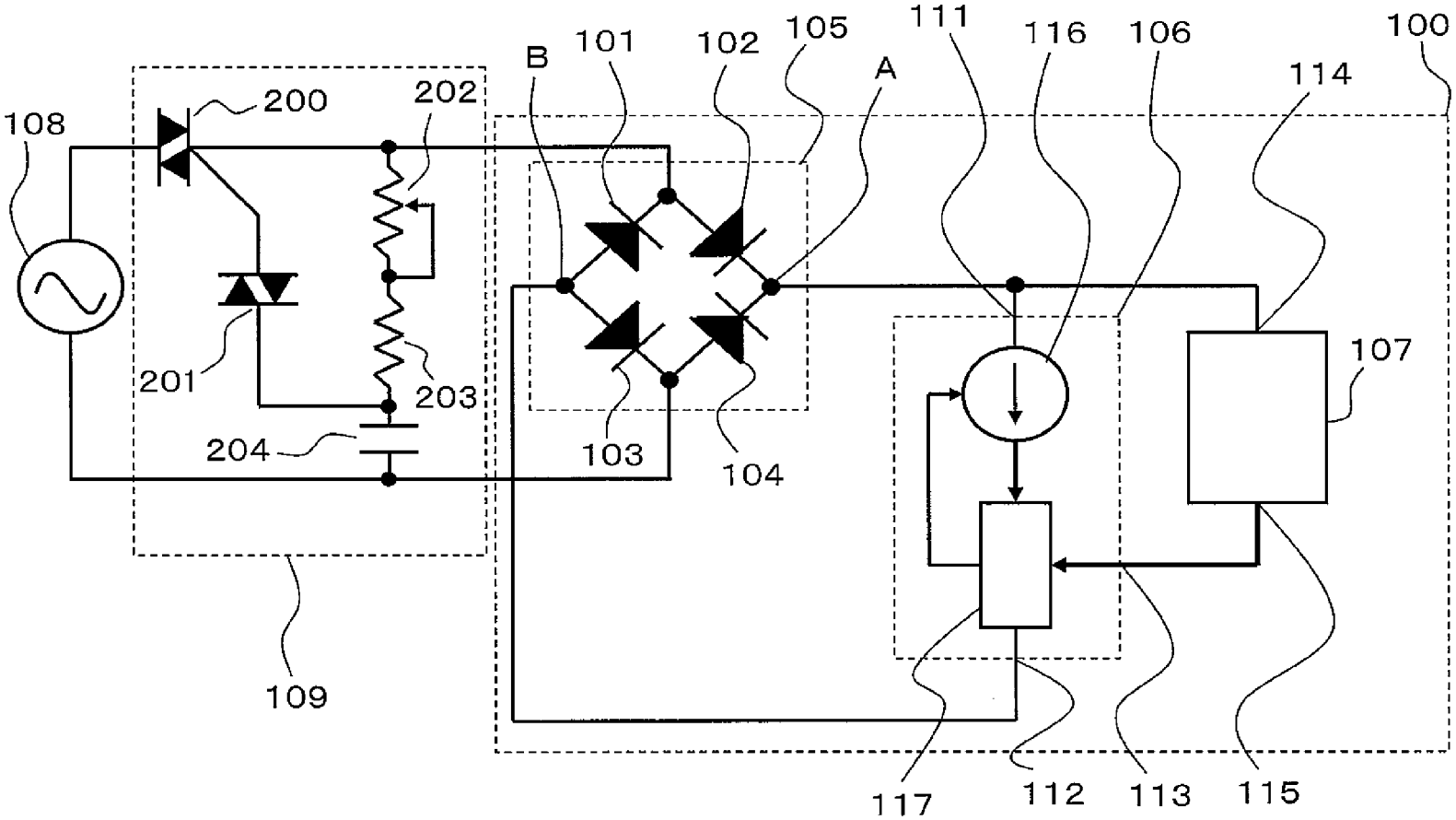
FIG. 1 is a schematic block diagram of an LED lighting apparatus 100.

LED lighting apparatus will be described below with reference to the drawings. It will, however, be noted that the technical scope of the present invention is not limited by any particular embodiment described herein but extends to the inventions described in the appended claims and their equivalents. Further, in the description of the drawings, the same or corresponding component elements are designated by the same reference numerals, and the description of such component elements, once given, will not be repeated thereafter. It will also be noted that the scale to which each component element is drawn is changed as needed for illustrative purposes.

FIG. 1 is a schematic block diagram of an LED lighting apparatus 100.

The LED lighting apparatus 100 is connected to the power output end of a dimmer 109, and the power input end of the dimmer 109 is connected to an AC commercial power supply 108. The LED lighting apparatus 100 comprises a rectifier circuit 105, a bypass circuit 106, and a light-emitting circuit 107.

The rectifier circuit 105 is a diode bridge constructed from four diodes 101 to 104, and the upper end and lower end of the diode bridge are connected to the power output end of the dimmer 109. A terminal A is the terminal at the current output end of the rectifier circuit 105, and a terminal B is the terminal at the current input end. While the rectifier circuit 105 is shown here by way of example as being a diode bridge constructed from four diodes, the configuration of the rectifier circuit 105 is not limited to this particular example, but any other suitable configuration may be employed. For example, the rectifier circuit 105 may be constructed from a single diode.

The bypass circuit 106 includes a positive power supply terminal 111 (third power supply terminal), a negative power supply terminal 112 (fourth power supply terminal), a current detecting terminal 113, a current limiting unit 116, and a current detecting unit 117. The positive power supply terminal 111 is connected at one end to the terminal A and at the other end to the upper end of the current limiting unit 116, while the negative power supply terminal 112 is connected at one end to the terminal B and at the other end to the lower end of the current detecting unit. Current flows into the current detecting unit 117 from the current limiting unit 116, and current also flows into it from the light-emitting circuit 107 via the current detecting terminal 113.

When the voltage measured between the terminals A and B of the rectifier circuit 105 is low (hereinafter, the voltage measured at the terminal A with respect to the terminal B is referred to as the voltage of the terminal A), the current flows from the positive power supply terminal 111 to the terminal B by passing through the current limiting unit 116, the current detecting unit 117, and the negative power supply terminal 112. When the voltage of the terminal A rises and reaches a point where the current also flows into the light-emitting circuit 107, feedback is applied so that the current flowing in the current detecting unit 117 is maintained substantially constant. When the voltage of the terminal A further rises, and the current passing through the current detecting terminal 113 exceeds a predetermined value, feedback is applied so as to reduce the current flowing into the bypass circuit 106 through the positive power supply terminal 111.

The light-emitting circuit 107 contains therein a single or a plurality of light-emitting diodes (hereinafter called the LEDs), and is provided with a positive power supply terminal 114 (first power supply terminal) and a negative power supply terminal 115 (second power supply terminal). The positive power supply terminal 114 is connected to the positive power supply terminal 111 of the bypass circuit 106 and hence to the terminal A. The negative power supply terminal 115 is connected to the current detecting terminal 113 of the bypass circuit 106.

Figure 2:
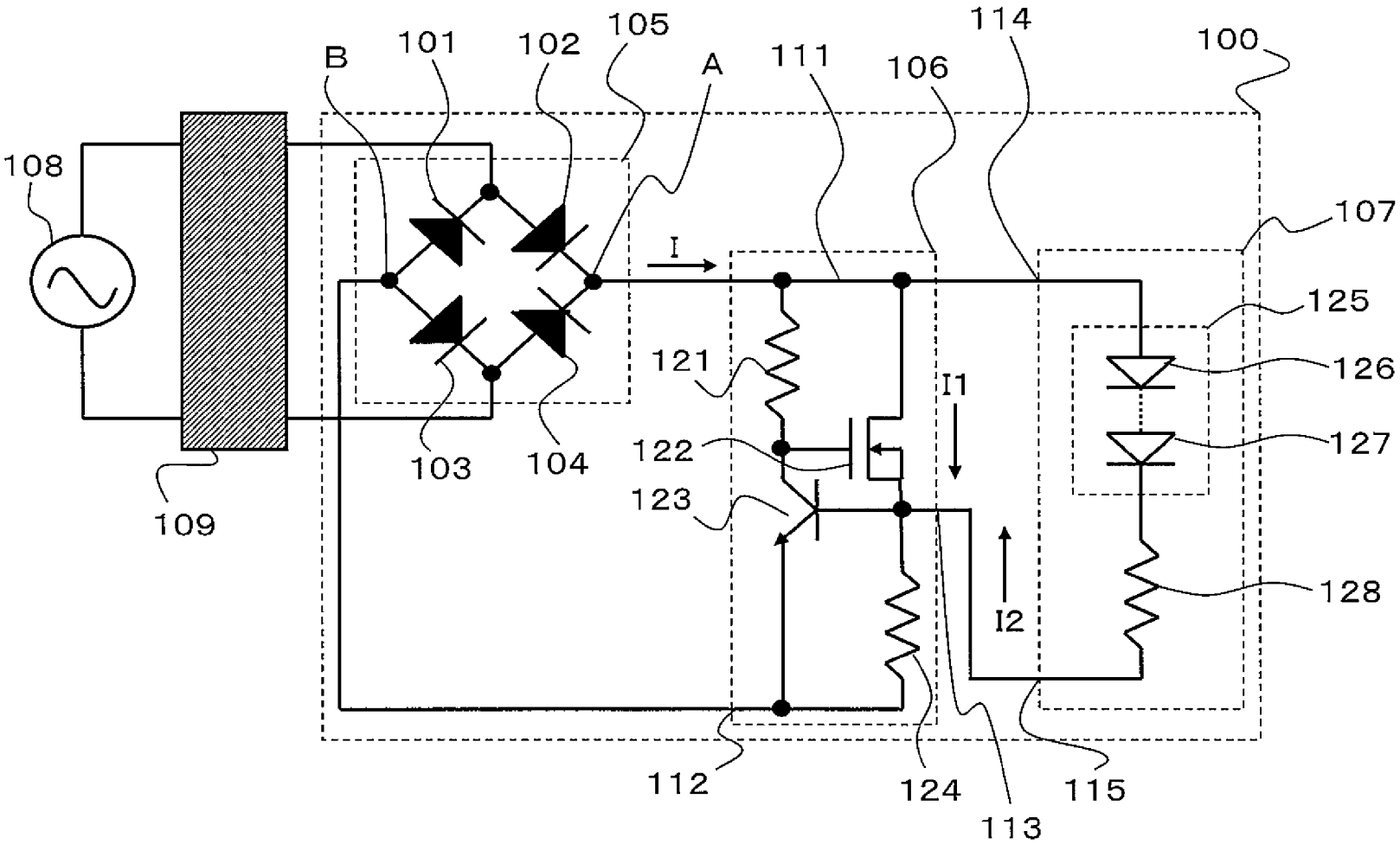
FIG. 2 is a circuit diagram of the LED lighting apparatus 100 shown in FIG. 1.

FIG. 2 is a circuit diagram of the LED lighting apparatus 100 shown in FIG. 1. In FIG. 2, the bypass circuit 106 and light-emitting circuit 107 contained in the LED lighting apparatus 100 of FIG. 1 are shown at the device level.

The bypass circuit 106 includes resistors 121 and 124, an n-channel enhancement-type MOS transistor 122 (hereinafter called the FET), and an NPN bipolar transistor 123 (hereinafter called the transistor). The light-emitting circuit 107 includes an LED array constructed from a series connection of a large number of LEDs including LEDs 126 and 127, and a resistor 128.

The positive power supply terminal 111 of the bypass circuit 106 is connected to the upper end of the resistor 121 and the drain of the FET 122, while the negative power supply terminal 112 is connected to the emitter of the transistor 123 and the lower end of the resistor 124. The current detecting terminal 113 is connected to a connection node at which the source of the FET 122, the base of the transistor 123, and the upper end of the resistor 124 are connected. The current I1 passing through the FET 122 and the current I2 flowing in from the light-emitting circuit 107 are directed toward the terminal B of the rectifier circuit 105 by passing through the resistor 124 and the transistor 123.

In FIG. 1, the functions of the current limiting unit 116 and current detecting unit 117 are depicted in block diagram form; here, the FET 122 substantially corresponds to the current limiting unit 116, and the resistor 124 corresponds to the current detecting unit. The resistor 121 and the transistor 123 together work to implement a feedback function for maintaining the current flowing through the resistor 124 at a constant level.

In the light-emitting circuit 107, when the forward voltage of each of the LEDs, including the LEDs 126 and 127, contained in the LED array 125 is about 3 V, the number of series-connected LED stages forming the LED array 125 is determined by the root-mean-square value of the AC commercial power supply 108. When the root-mean-square value of the AC commercial power supply 108 is 100 to 120 V, the number of series-connected LED stages is, for example, 30 to 40, and when the root-mean-square value of the AC commercial power supply 108 is 200 to 240 V, the number of series-connected LED stages is, for example, 60 to 80. The resistor 128 limits the current flowing into the LED array 125. The positive power supply terminal 114 of the light-emitting circuit 107 is connected to the anode of the LED array 125, and the negative power supply terminal 115 is connected to the lower end of the resistor 128.

The operation of the bypass circuit 106 will be described below. For convenience, it is assumed that the voltage of the terminal A starts at 0 V and rises as the time elapses.

When the voltage of the terminal A of the rectifier circuit 105 is 0 V, the current I1 does not flow. When the voltage of the terminal A subsequently rises, the current I1 begins to flow through the positive power supply terminal 111, and thereafter, the current I1 maintained at a constant level flows so as to hold the base-emitter voltage of the transistor 123 at about 0.6 V.

When the voltage of the terminal A further rises, and the current I2 begins to flow into the light-emitting circuit 107, the current I1 is regulated so that the product of the sum of the currents I1 and I2 and the resistor 124 becomes equal to about 0.6 V. That is, there exists a voltage range over which the sum of the current I1 flowing in through the positive power supply terminal 111 and the current I2 flowing in through the current detecting terminal 113 is constant. In this voltage range, the transistor 123 in the bypass circuit 106 is in a non-saturated condition, and the sum of the currents I1 and I2 is maintained constant by reference to the base-emitter voltage.

When the voltage of the terminal A further rises, and the current passing through the current detecting terminal 113 exceeds a predetermined value, the transistor 123 is saturated, and the FET 122 is cut off. As a result, the current no longer flows through the positive power supply terminal 111, and the current flowing back to the terminal B of the rectifier circuit 105 through the current detecting terminal 113 is only the current I2 flowing through the light-emitting circuit 107. Here, the magnitude of the current flowing through the resistor 121 is small enough that it can be neglected. The current I2 is limited by the resistor 128, but increases as the voltage of the terminal A rises.

FIG. 3 is a waveform diagram for the case where the circuit shown in FIG. 2 is operated by using the output of the dimmer 109. FIG. 3(*a*) is a diagram depicting the voltage measured at the terminal A with respect to the terminal B in the LED lighting apparatus 100 shown in FIG. 1, and FIG. 3(*b*) is a diagram depicting the waveform of the current I flowing through the terminal A in response to the voltage of FIG. 3(*a*).

As shown in FIG. 3(*a*), the dimmer 109 produces an output voltage by truncating a portion of the pulsating voltage, and when the output voltage is full-wave rectified by the rectifier circuit 105, the resulting waveform is such that the truncated portion is held at 0 V. The dotted line in FIG. 3(*a*) indicates the pulsating voltage when no dimming control was applied.

As shown in FIG. 3(*b*), the current I first rises from 0 A and reaches a constant value. Since, in actuality, a slight amount of voltage (a few volts) is present even in the portion where the voltage of the terminal A is shown as being 0 V in FIG. 3(*a*), the current I1 is allowed to flow through the bypass circuit 106, thereby stabilizing the operation of the dimmer 109 during the period when only a slight amount of voltage (a few volts) is present.

Next, when the voltage of the terminal A sharply rises, the current I2 flows into the light-emitting circuit 107, and the current waveform also rises sharply (see t10). At this time, since the current rises above the limit below which the bypass circuit 106 can maintain the sum of the currents I1 and I2 constant, the transistor 123 is saturated, and the FET 122 is cut off. As a result, the current I1 drops to 0 A, and the current I becomes equal to the current I2. Then, the waveform of the current I varies substantially linearly with the voltage waveform of the terminal A (see FIG. 3(*a*)).

After that, the voltage of the terminal A drops, and there appears a period during which the current I is constant (see t11). In the period t11, the base voltage of the transistor 123 drops, and the feedback path is again formed to maintain the sum of the currents I1 and I2 constant. In the first half of the period t11, the current I2 is still flowing, but in the second half, only the current I1 flows. After the period t11, the current I1 finally drops to 0 A, and the current I no longer flows. The dotted line in FIG. 3(*b*) indicates the waveform of the current I when no dimming control was applied.

The dimmer 109 is a leading-edge type dimmer which operates so as to truncate the first half portion of the pulsating voltage, and comprises, for example, a triac 200, a diac 201, a potentiometer 202, a resistor 203, and a capacitor 204. Alternatively, the dimmer 109 may be configured as a trailing-edge type dimmer which operates so as to truncate the second half portion of the pulsating voltage. Further alternatively, the dimmer 109 may be configured to operate so as to truncate the first half and the second half of the pulsating voltage in alternating fashion. Regardless of the type of the dimmer, it becomes possible to stabilize the operation of the dimmer by flowing a bypass current through the bypass circuit during the period corresponding to the truncated portion of the voltage waveform.

Figure 4:
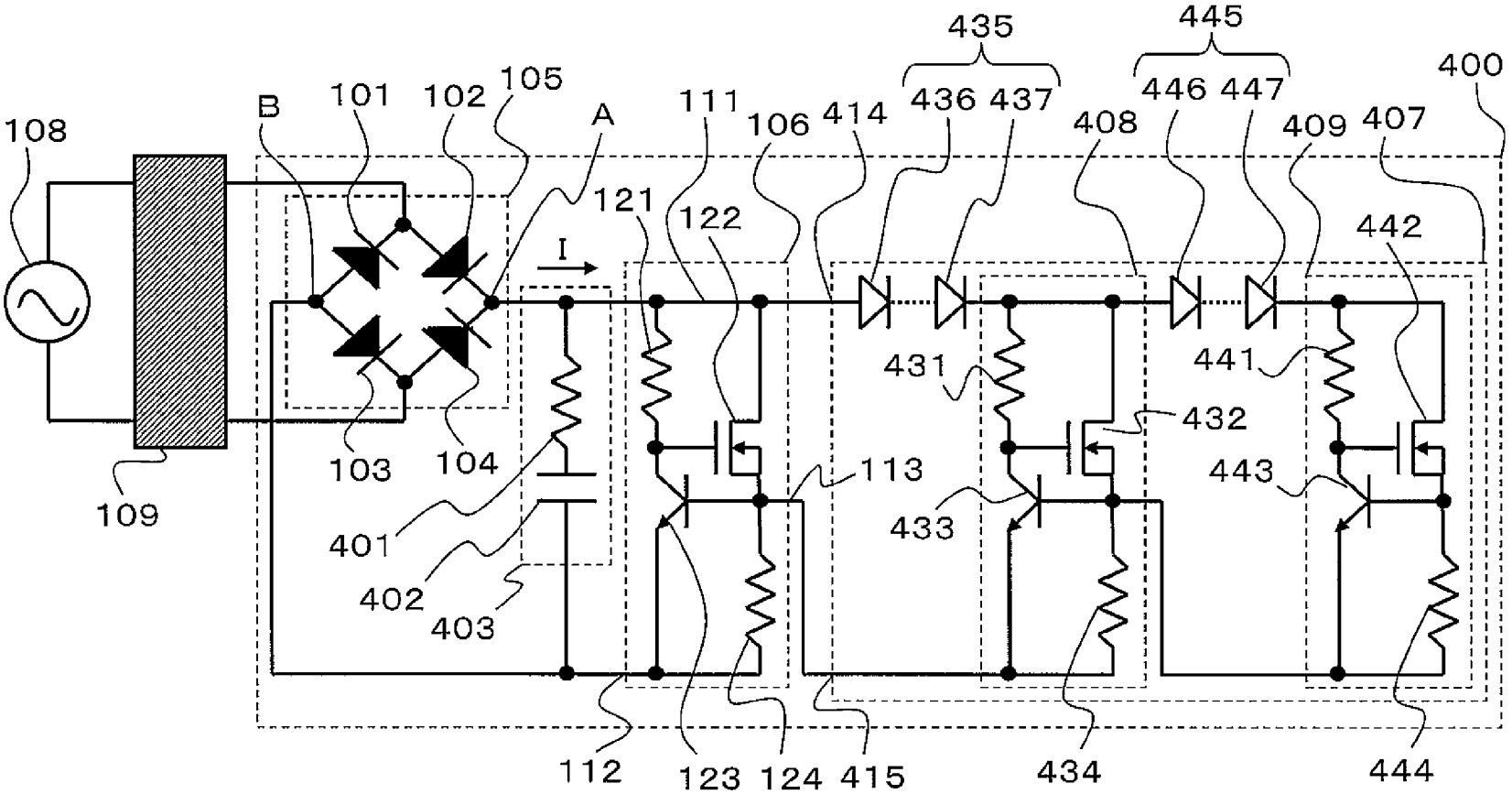
FIG. 4 is a circuit diagram of an alternative LED lighting apparatus 400.

FIG. 4 is a circuit diagram of an alternative LED lighting apparatus 400.

The light-emitting circuit 107 contained in the LED lighting apparatus 100 shown in FIGS. 1 and 2 was a simple one that contained only one LED array 125. In this case, the light emission period becomes short compared with one pulsating cycle, and hence, flicker and motion breaks may become noticeable. An effective method to lengthen the light emission period is to change the number of series-connected stages of LED arrays according to the voltage or the current. In the LED lighting apparatus 400, the number of series-connected stages of LED arrays is changed according to the current, with provisions made not to cause a faulty operation even when the output of the dimmer is used.

In FIG. 4, the AC commercial power supply 108, the dimmer 109, the rectifier circuit 105, and the bypass circuit 106 are the same as those shown in FIG. 2. The LED lighting apparatus 400 of FIG. 4 differs from the LED lighting apparatus 100 of FIG. 2 in that the light-emitting circuit 407 in the LED lighting apparatus 400 has multiple stages and in that a filter circuit 403 is inserted in parallel with the bypass circuit 106.

When FIG. 4 is compared with FIG. 1, the light-emitting circuit 407 in FIG. 4 corresponds to the light-emitting circuit 107 in FIG. 1, the positive power supply terminal 414 of the light-emitting circuit 407 in FIG. 4 corresponds to the positive power supply terminal 114 of the light-emitting circuit 107 in FIG. 1, and the negative power supply terminal 415 of the light-emitting circuit 407 in FIG. 4 corresponds to the negative power supply terminal 115 of the light-emitting circuit 107 in FIG. 1.

The light-emitting circuit 407 comprises an LED array 435 constructed from LEDs 436 and 437 and an LED array 445 constructed from LEDs 446 and 447. A second bypass circuit 408 is connected between the LED arrays 435 and 445, and a current limiting circuit 409 is connected to the cathode side of the LED array 445. When the root-mean-square value of the AC commercial power supply 108 is 100 to 120 V, the number of series-connected stages may be, for example, 25 for the LED array 435 and 15 for the LED array 445, and when the root-mean-square value of the AC commercial power supply 108 is 200 to 240 V, the number of series-connected LEDs may be, for example, 50 for the LED array 435 and 30 for the LED array 445.

The second bypass circuit 408 comprises a resistor 431, an FET 432, a transistor 433, and a resistor 434, and is thus identical in circuit configuration to the bypass circuit 106, but the value of the resistor 434 differs from the value of the resistor 124 in the LED lighting apparatus 100 shown in FIG. 2. Similarly, the current limiting circuit 409 comprises a resistor 441, an FET 442, a transistor 443, and a resistor 444, and is thus identical in circuit configuration to the bypass circuit 106, but the value of the resistor 444 differs from the value of the resistor 124 in the LED lighting apparatus 100 shown in FIG. 2. Here, the value of the resistor 444 is smaller than the value of the resistor 434 which is smaller than the value of the resistor 124.

The operation of the light-emitting circuit 407 will be described below. For convenience, it is assumed that the voltage of the terminal A starts at 0 V and rises as the time elapses.

When the voltage of the terminal A of the rectifier circuit 105 is 0 V, the current I does not flow. When the voltage of the terminal A subsequently rises and exceeds the threshold value of the LED 435, the current I begins to flow into the light-emitting circuit 407, and there appears a voltage range where a constant current flows so as to maintain the base-emitter voltage of the transistor 433 at about 0.6 V. In the first half of this voltage range, the current flows only into the FET 432 contained in the bypass circuit 408, and in the second half, the current passing through the LED array 445 also flows. In this voltage range, the sum of the current flowing through the FET 432 contained in the bypass circuit 408 and the current flowing through the LED array 445 is maintained constant.

When the voltage of the terminal A further rises, the current flowing through the LED array 445 and through the current limiting circuit 409 increases, and the transistor 433 saturates; as a result, the bypass circuit 408 is cut off, and the current no longer flows to the FET 432. When the bypass circuit 408 is cut off, if the voltage of the terminal A further rises the current flowing through the LED array 445 is limited by the current limiting circuit 409. Since the current flowing through the light-emitting circuit 407 can thus be prevented from increasing above its upper limit value, the current limiting circuit 409 can ensure stable operation of the light-emitting circuit 407 even when the AC commercial power supply 108 or the output voltage of the dimmer 109 is unstable.

If the bypass circuit 106 and the filter circuit 403 formed from a series connection of a resistor 401 and a capacitor 402 were removed from the LED lighting apparatus 400, the waveform of the voltage at the terminal A in FIG. 4 would be as shown in FIG. 10(*b*). That is, abnormal voltage would appear during the period when the voltage should normally be 0 V and, at the same time, sharp peaks would appear during the period when a portion of the pulsating voltage should normally appear. On the other hand, if the bypass circuit 106 alone were removed from the LED lighting apparatus 400, the peaks occurring in the second half portion in FIG. 10(*b*) would disappear from the waveform of the voltage at the terminal A in FIG. 4, but the abnormal voltage in the first half portion would not disappear. If, for example, an LED lighting apparatus consisting only of the bypass circuit 106 and light-emitting circuit 407 were connected to the dimmer 109, the load balance would be disrupted, causing oscillations in the voltage of the terminal A, even during the period when the LED lighting apparatus should normally cause the LEDs to light (see FIG. 10). By contrast, in the LED lighting apparatus 400, since the filter circuit 403 is inserted, such oscillations can be suppressed, serving to achieve stable operation. In particular, when the amount of current to be supplied to the LED array is small, the effect of inserting the filter circuit 403 is enormous.

Further, when it is attempted to reduce the current flowing to the bypass circuit 106, the stability of the LED lighting apparatus 400 to the dimmer degrades but, by inserting the filter circuit 403, the stability can be recovered. That is, it can be seen that the filter circuit 403 formed by connecting the resistor 401 and the capacitor 402 in series serves to stabilize the operation of the LED lighting apparatus 400. In the filter circuit 403, the value of the resistor 401 may be set, for example, to 1 kΩ, and the value of the capacitor 402 may be set, for example, to 0.047 μF.

FIG. 5 is a waveform diagram for the case where the circuit shown in FIG. 4 is operated by using the output of the dimmer 109. FIG. 5(*a*) is a diagram depicting the voltage measured at the terminal A with respect to the terminal B in the LED lighting apparatus 400 shown in FIG. 4, and FIG. 5(*b*) is a diagram depicting the waveform of the current I flowing through the terminal A in response to the voltage of FIG. 5(*a*).

The dimmer 109 produces an output by truncating a portion of the pulsating wave, the output waveform being such that the truncated portion is held at 0 V; therefore, when the output waveform is full-wave rectified by the rectifier circuit 105, the resulting waveform is such that there is no voltage in the first half and a portion of the pulsating voltage appears in the second half, as shown by a solid line in FIG. 5(*a*). In FIG. 5(*a*), the dotted line indicates the pulsating voltage when no dimming control was applied. The operation of the bypass circuit 106 is basically the same as that described for the LED lighting apparatus 100, but the operation will be described in detail below for the LED lighting apparatus 400 shown in FIG. 4.

As shown in FIG. 5(*b*), the current I first rises from 0 A and reaches a constant value. This is because, in actuality, a slight amount of voltage (a few volts) is present even in the portion where the voltage of the terminal A is shown as being 0 V in FIG. 5(*a*), and as a result, the current flows through the bypass circuit 106. Next, when the voltage of the terminal A rises, the current flows through the LED array 435, and the current waveform rapidly rises (see time t20). At time t20, the bypass circuit 106 is cut off, the current flowing through the FET 122 drops to 0 A, and the current I is equal to the current flowing through the LED array 435. In FIG. 5(*b*), the dotted line indicates the pulsating current when no dimming control was applied.

As earlier described, there are three voltage ranges in the operation of the light-emitting circuit 407: the first voltage range in which the bypass circuit 106 and the second bypass circuit 408 are both cut off and the current flowing through the LED array 445 is limited by the current limiting circuit 409; the second voltage range over which the sum of the current flowing through the second bypass circuit 408 are the current flowing through the LED array 445 is maintained constant according to the voltage of the terminal A; and the third voltage range over which the sum of the current flowing through the bypass circuit 106 are the current flowing through the LED array 435 is maintained constant. Accordingly, the waveform of the current I has three levels as shown in FIG. 5(*b*), that is, the first level (L1) corresponding to the first voltage range, the second level (L2) corresponding to the second voltage range, and the third level (L3) corresponding to the third voltage range. FIG. 5 shows the case where the LEDs being to light in the voltage range in which the voltage of the terminal A is current-limited; generally, the waveform of the current I subjected to dimming is obtained by removing a portion from the source waveform (indicated by the dotted line plus the succeeding portion of the solid line) not subjected to dimming.

In the LED lighting apparatus 400, the number of series-connected stages of LED arrays is changed by detecting the current, but the number of series-connected stages of LED arrays may be changed by detecting the voltage. However, with the method that changes the number of series-connected stages of LED arrays by detecting the voltage, the current value may change abruptly so as to produce a sharp peak when changing the number of series-connected stages of LED arrays, and this can result in the generation of harmonic noise. By contract, in the LED lighting apparatus 400 that changes the number of series-connected stages of LED arrays by detecting the current, since the current can be made to change so as to follow voltage changes, it becomes possible to prevent harmonic noise and to maintain good power factor and good distortion factor.

In the LED lighting apparatus 400, the number of series-connected stages is changed by switching between two LED arrays, but the number of series-connected stages to be changed is not limited to two. For example, when connecting five LED arrays in series, five sets of circuits are provided, each set being identical in configuration to the set comprising the LED array 435 and the second bypass circuits 408. Then, the thus provided five sets of circuits are connected in cascade in a manner similar to the manner in which the set comprising the LED array 445 and the current limiting circuit 409 is connected to the set comprising the LED array 435 and the second bypass circuits 408 in the LED lighting apparatus. The value of the resistor connected to the source of the FET is different for each set.

Figure 6:
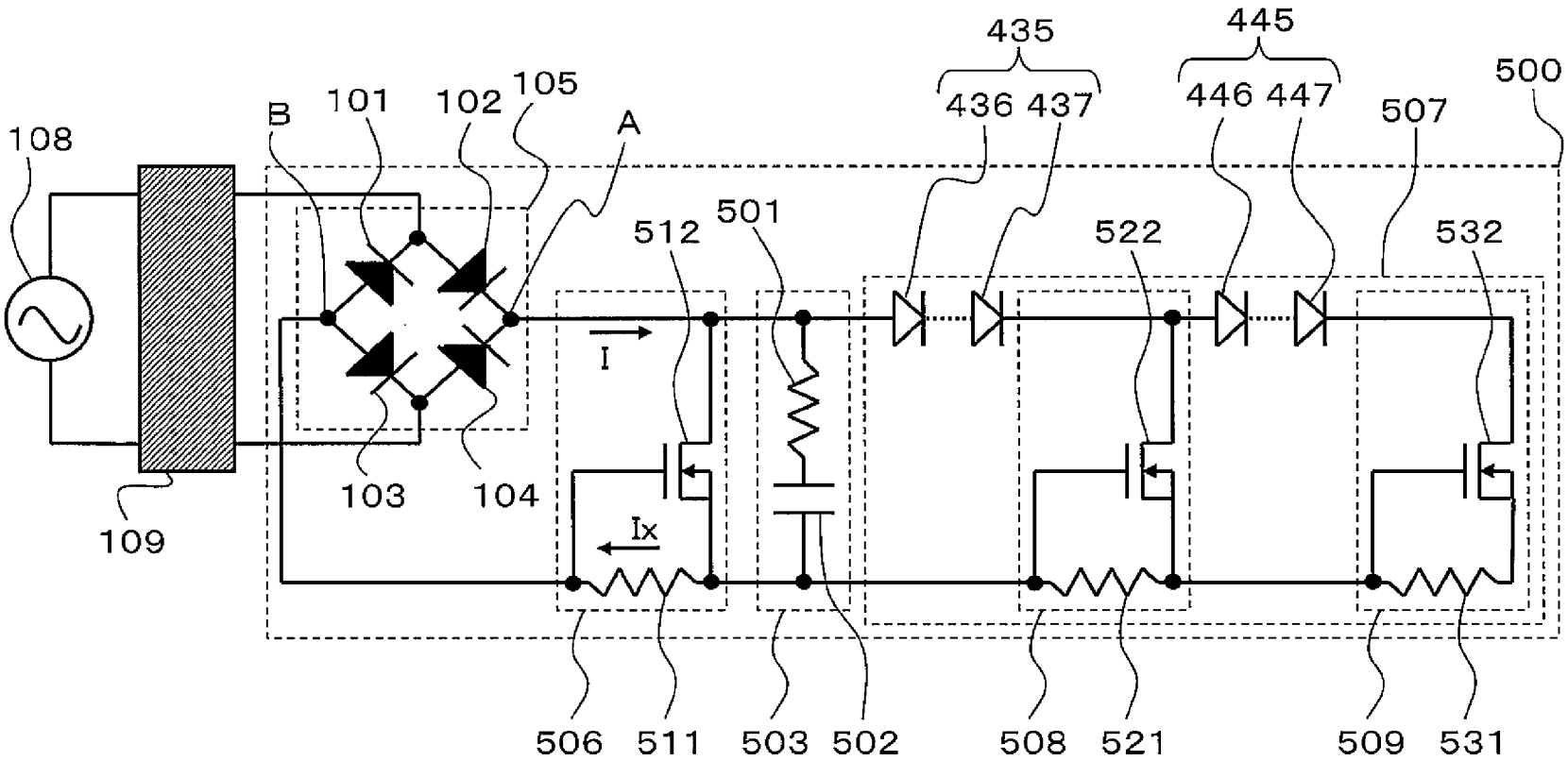
FIG. 6 is a circuit diagram of a further alternative LED lighting apparatus 500.
Figure 7:
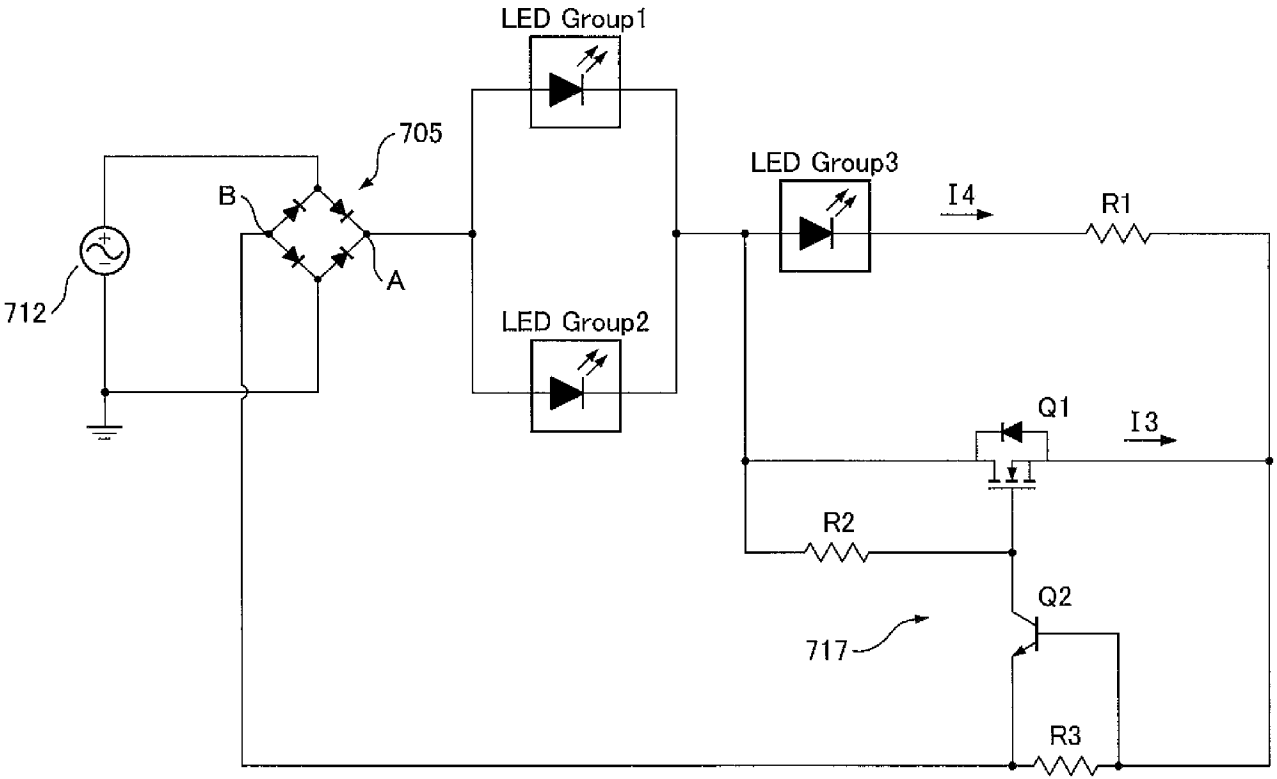
Fig.7 PRIOR ART
FIG. 7 is a diagram showing an LED lighting apparatus illustrated in FIG. 26 in patent document 1.
Figure 9:
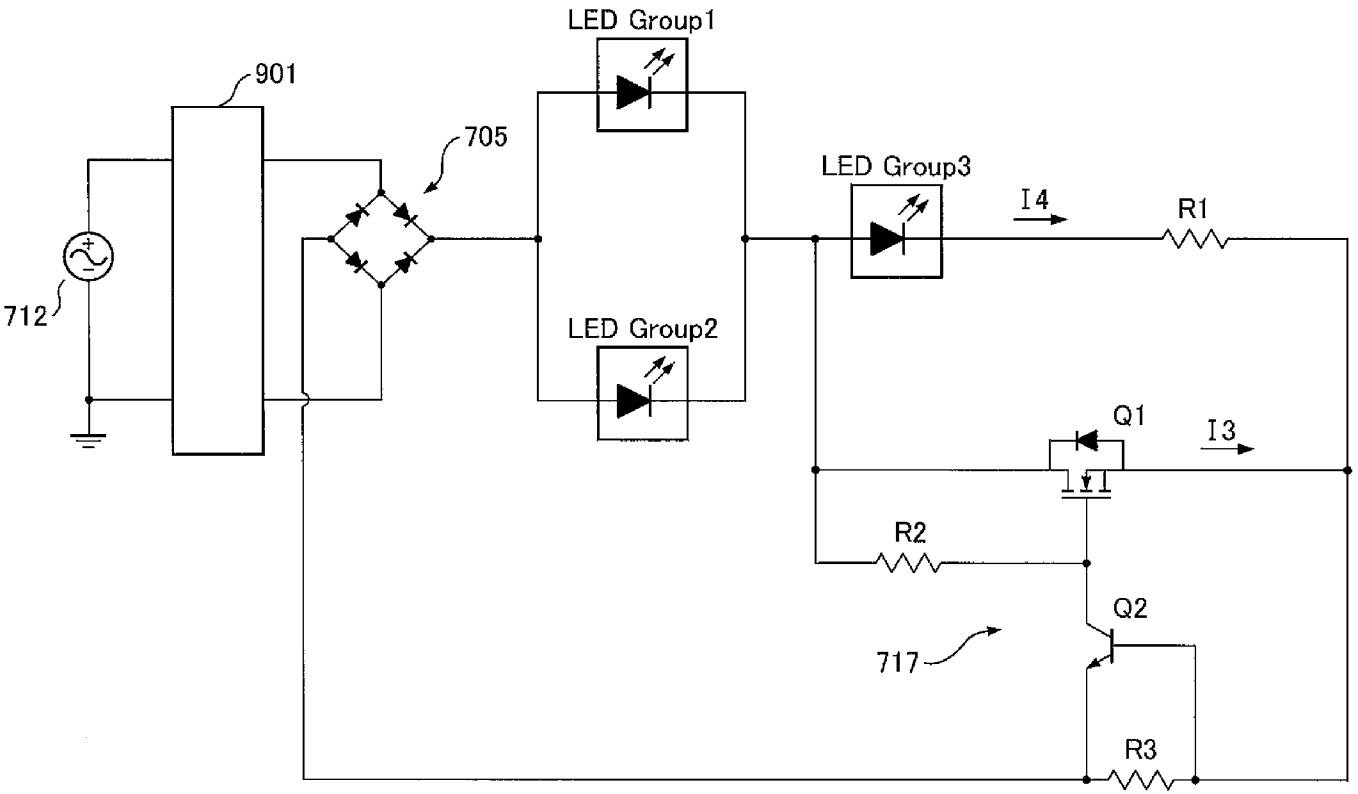
Fig.9 PRIOR ART
FIG. 9 is a diagram showing an example in which a dimmer 901 is inserted between an AC commercial power supply and the bridge rectifier circuit 705 in the LED lighting apparatus shown in FIG. 7.

FIG. 6 is a circuit diagram of a further alternative LED lighting apparatus 500.

In FIG. 6, the AC commercial power supply 108, the dimmer 109, and the rectifier circuit 105 are the same as those shown in FIG. 4. The LED lighting apparatus 500 of FIG. 6 differs from the LED lighting apparatus 400 of FIG. 4 in the circuit configuration of the bypass circuit 506, second bypass circuit 508, and current limiting circuit 509 and in the position of the filter circuit 503.

In the LED lighting apparatus 400 of FIG. 4, the bypass circuit 106, the second bypass circuit 408, and the current limiting circuit 409 are each constructed using two resistive elements, an n-channel enhancement-type MOS transistor (FET), and an NPN bipolar transistor. On the other hand, in the LED lighting apparatus 500 of FIG. 6, the corresponding circuits are each constructed using a depletion-type FET and a single resistor.

In the bypass circuit 506, the drain of the FET 512 is connected to the output terminal A of the rectifier circuit 105, the gate is connected to one end of the resistor 511, and the source is connected to the other end of the resistor 511. When a current Ix flow through the resistor 511, a voltage drop occurs, and a potential difference develops between the gate voltage VG and source voltage VS of the FET 512. The depletion-type FET operates so as to turn off when the VG-VS potential difference becomes lower than an offset value. Accordingly, in the bypass circuit 506, when the current Ix flowing through the resistor 511 increases due to the current flowing through the light-emitting circuit 507, the FET 512 turns off, and the current flowing between the drain and source of the FET 512 is shut off.

The second bypass circuit 508 and the current limiting circuit 509 operate in the same manner as the above bypass circuit 506. The bypass circuit 506, second bypass circuit 508, and current limiting circuit 509 provided in the LED lighting apparatus 500 of FIG. 6 function in the same manner as the bypass circuit 106, second bypass circuit 408, and current limiting circuit 409 provided in the LED lighting apparatus 400 of FIG. 4. That is, the bypass circuit 506, second bypass circuit 508, and current limiting circuit 509 switch the output current path of the rectifier circuit 105 and restrict the upper limit value.

Accordingly, in the operation of the light-emitting circuit 507, as in the operation of the light-emitting circuit 407 shown in FIG. 4, there are three voltage ranges: the first voltage range in which the bypass circuit 506 and the second bypass circuit 508 are both cut off and the current flowing through the LED array 445 is limited by the current limiting circuit 509; the second voltage range over which the sum of the current flowing through the second bypass circuit 508 are the current flowing through the LED array 445 is maintained constant according to the voltage of the terminal A; and the third voltage range over which the sum of the current flowing through the bypass circuit 506 are the current flowing through the LED array 435 is maintained constant.

In the LED lighting apparatus 500 of FIG. 5, the filter circuit 503 is placed directly after the bypass circuit 506. The bypass circuit 506, like the bypass circuit 106 (see FIG. 4), has the function of preventing malfunction of the dimmer 109 by continuing to flow a small amount of current to the dimmer 109 throughout the period during which the voltage is substantially held at 0 V. Further, in the LED lighting apparatus 500, the filter circuit 503 suppresses voltage oscillations that may occur due to mismatching between the load and the dimmer 109. To feed back the current flowing through the filter circuit 503 to the bypass circuit 506, the filter circuit 503 is placed directly after the bypass circuit 506. This arrangement serves to reduce the current flowing through the filter circuit 503. The filter circuit 503 is identical in configuration and function to the filter circuit 403 (see FIG. 4).

The LED lighting apparatuses 100, 400, and 500 described above properly operate at low power consumption even when they are connected to the AC commercial power supply without using the dimmer 109.

What is claimed is:

1. An LED lighting apparatus comprising:

a rectifier circuit connected to a dimmer, wherein said dimmer modifies a waveform of voltage, so that the waveform has a truncated voltage period where a portion of the voltage is truncated and a non-truncated voltage period where the voltage is present only in a specific period;

a first light-emitting circuit connected to said rectifier circuit and containing a single or a plurality of LEDs in which current begins to flow when an output voltage of said rectifier circuit exceeds a threshold voltage;

a first bypass circuit having a first terminal, a second terminal, a bypass path for making the current flow to said rectifier circuit without passing through said first light-emitting circuit, so that the current flows through said first bypass circuit in the truncated voltage period in order to stabilize an operation of said dimmer, and a detecting unit for detecting the current flowing through said first light-emitting circuit, a second bypass circuit connected to said first light-emitting circuit;

a second light-emitting circuit connected to said second bypass circuit and containing a single or a plurality of LEDs in which current begins to flow when the output voltage of said rectifier circuit exceeds a threshold voltage;

a current limiting circuit for limiting the current flowing into said second light-emitting circuit; and a filter circuit, which is constructed from a resistor and a capacitor, and which has a first terminal and a second terminal, in which said first terminal of said filter circuit is connected to said first terminal of said first bypass circuit, and said second terminal of said filter circuit is connected to said second terminal of said first bypass circuit, wherein said first bypass circuit is connected to a current output end of said rectifier circuit and a current input end of said first light-emitting circuit, and wherein when the current detected by said detecting unit exceeds a predetermined value, said first bypass circuit shuts off the current flowing through said bypass path.

2. The LED lighting apparatus according to claim 1, wherein said first bypass circuit maintains the sum of the current flowing through said first bypass circuit and the current flowing through said first light-emitting circuit constant.

3. The LED lighting apparatus according to claim 1, wherein said first bypass circuit includes a current detecting resistor and a depletion-type FET placed in said bypass path, and wherein said depletion-type FET controls opening and closing of said first bypass path by detecting the current flowing through said first light-emitting circuit by said current detecting resistor.

4. The LED lighting apparatus according to claim 2, wherein said first bypass circuit includes a current detecting resistor and a depletion-type FET placed in said bypass path, and wherein said depletion-type FET controls opening and closing of said first bypass path by detecting the current flowing through said first light-emitting circuit by said current detecting resistor.

5. The LED lighting apparatus according to claim 1, wherein said first bypass circuit includes a current detecting resistor and an enhancement-type FET placed in said bypass path, a bipolar transistor for controlling said enhancement-type FET, and a pull-up resistor, and wherein said bipolar transistor detects the current flowing through said first light-emitting circuit by said current detecting resistor, and controls opening and closing of said bypass path by using said enhancement-type FET.

6. The LED lighting apparatus according to claim 2, wherein said first bypass circuit includes a current detecting resistor and an enhancement-type FET placed in said bypass path, a bipolar transistor for controlling said enhancement-type FET, and a pull-up resistor, and wherein said bipolar transistor detects the current flowing through said first light-emitting circuit by said current detecting resistor, and controls opening and closing of said bypass path by using said enhancement-type FET.

7. The LED lighting apparatus according to claim 1, wherein said filter circuit is placed after said first bypass circuit but before said first light-emitting circuit.

* * * * *